US007278171B1

(12) United States Patent
Besch

(10) Patent No.: US 7,278,171 B1
(45) Date of Patent: Oct. 9, 2007

(54) CLOTHING PROTECTOR SYSTEM

(76) Inventor: Louise Willard Besch, 73 Parker Rd., West Sand Lake, NY (US) 12196

( * ) Notice: Subject to any disclaimer, the term of this patent is extended or adjusted under 35 U.S.C. 154(b) by 0 days.

(21) Appl. No.: 11/530,701

(22) Filed: Sep. 11, 2006

(51) Int. Cl.
*A41D 13/04* (2006.01)

(52) U.S. Cl. ..... 2/48; 2/49.1; 2/49.2

(58) Field of Classification Search ..... 2/48, 2/49.1–49.5, 50, 51, 52, 46, 47, 88, 104, 2/103, 95, 69.5, 207, 89, 174, 84, 85, 87, 2/105, 106, 108, 114, 94; D2/773, 823, 824, D2/825, 826, 500, 860–864
See application file for complete search history.

(56) References Cited

U.S. PATENT DOCUMENTS

| | | | | | |
|---|---|---|---|---|---|
| 187,720 | A | * | 2/1877 | Loffler et al. | 2/103 |
| 289,236 | A | * | 11/1883 | Dodge et al. | 2/51 |
| 1,915,597 | A | * | 6/1933 | Ducker | 2/95 |
| 2,124,366 | A | * | 7/1938 | De Lasarte | 2/114 |
| 2,580,388 | A | | 1/1952 | Allen | 2/49 |
| 2,870,448 | A | | 1/1959 | Rosenthal | 2/91 |
| 3,416,157 | A | | 12/1968 | Marder et al. | 2/49 |
| D220,163 | S | * | 3/1971 | Meyers | D2/823 |
| 3,914,797 | A | | 10/1975 | Stembridge | 2/49 R |
| 4,079,465 | A | * | 3/1978 | Alexander | 2/48 |
| 4,569,086 | A | | 2/1986 | Takefman | 2/49 R |
| 4,660,224 | A | | 4/1987 | Ashcraft | 2/48 |
| 5,077,838 | A | * | 1/1992 | Senser | 2/69 |
| D325,114 | S | | 4/1992 | Reed | D2/227 |
| 6,047,402 | A | | 4/2000 | Chester-Salter | 2/46 |
| 6,058,506 | A | | 5/2000 | Reinhart, Jr. | 2/49.2 |
| 6,105,165 | A | | 8/2000 | Johnson et al. | 2/49.2 |
| 6,151,715 | A | * | 11/2000 | Doherty | 2/48 |
| 6,182,290 | B1 | | 2/2001 | Morris | 2/49.1 |
| 6,330,720 | B1 | * | 12/2001 | Steelman | 2/93 |
| 6,353,933 | B1 | * | 3/2002 | Love | 2/88 |
| D480,538 | S | | 10/2003 | Calloway | D2/862 |
| D483,552 | S | | 12/2003 | Hughes | D2/861 |
| D491,342 | S | | 6/2004 | Jordan | D2/863 |
| 6,789,265 | B1 | | 9/2004 | Vonrinteln | 2/49.2 |
| 7,188,372 | B2 | * | 3/2007 | Stockard | 2/104 |
| 2004/0098781 | A1 | | 5/2004 | Sky | 2/49.2 |
| 2004/0205876 | A1 | | 10/2004 | Bruffett | 2/49.2 |
| 2005/0241043 | A1 | * | 11/2005 | Willis | 2/49.1 |
| 2006/0059597 | A1 | * | 3/2006 | LaRocco | 2/49.1 |
| 2006/0079855 | A1 | * | 4/2006 | Hooper | 604/385.01 |

* cited by examiner

*Primary Examiner*—Amy B. Vanatta
(74) *Attorney, Agent, or Firm*—Heslin Rothenberg Farley & Mesiti P.C.; Victor A. Cardona

(57) ABSTRACT

A clothing protector system includes a bib for protecting an article of clothing of a user and a scarf. The bib has a front side configured to face outwardly from a user, a back side configured to contact the user, and opposite longitudinal sides. The scarf is attached to the opposite longitudinal sides of the bib and includes two portions opposite one another across the bib. A first side of each of the scarf portions is connected to one of the opposite longitudinal sides of the bib. A second side of each of the scarf portions projects away from the bib and is configured to hide an interface between the bib and the article of clothing when the bib is placed on the article of clothing. A receiving pocket is attached to the bib and is configured to receive the bib and the scarf therein. The receiving pocket is connected to the back side of the bib opposite the front side.

23 Claims, 5 Drawing Sheets

CLOTHING PROTECTOR SYSTEM

BACKGROUND OF THE INVENTION

There are many variations of bibs and other clothing protectors which are utilized to prevent the soiling of clothing by food or other contaminants. Such clothing protectors are typically designed solely for functional use without taking into account the need for aesthetic appeal and for the user to have confidence in such aesthetic appeal during use. Moreover, such clothing protectors do not provide for the transport and containment of such a clothing protector before and after use.

Thus, a need exists for a clothing protector which is aesthetically appealing and includes means for transporting the clothing protector before and after use.

SUMMARY OF THE INVENTION

The present invention provides, in a first aspect, a clothing protector system which includes a bib for protecting an article of clothing of a user which has a front side configured to face outwardly from a user, a back side configured to contact the user, and opposite longitudinal sides. A scarf is attached to the opposite longitudinal sides of the bib, and includes two portions opposite one another across the bib. The first side of each of the scarf portions is connected to one of the opposite longitudinal sides of the bib. A second side of each of the scarf portions projects away from the bib and is configured to hide an interface between the bib and the article of clothing when the bib is placed on the article of clothing. A receiving pocket is attached to the bib and is configured to receive the bib and the scarf therein. The receiving pocket is connected to the back side of the bib opposite the front side.

The present invention provides, in a second aspect, a method for use in protecting clothing which includes attaching a scarf to a bib for protecting an article of clothing of a user such that opposite scarf portions of the scarf are located opposite one another across the bib. The first side of each of the scarf portions is connected to one of the opposite longitudinal sides of the bib, and a second side of each of the scarf portions projects away from the bib and is configured to hide an interface between the bib and the article of clothing when the bib is placed on the article of clothing. A receiving pocket is attached to the bib and is configured to receive the bib and the scarf therein.

These, and other objects, features and advantages of this invention will become apparent from the following detailed description of the various aspects of the invention taken in conjunction with the accompanying drawings.

DETAILED DESCRIPTION OF THE INVENTION

In accordance with the principals of the present invention, a clothing protector system and a method for use in protecting clothing are provided.

Figure 1:
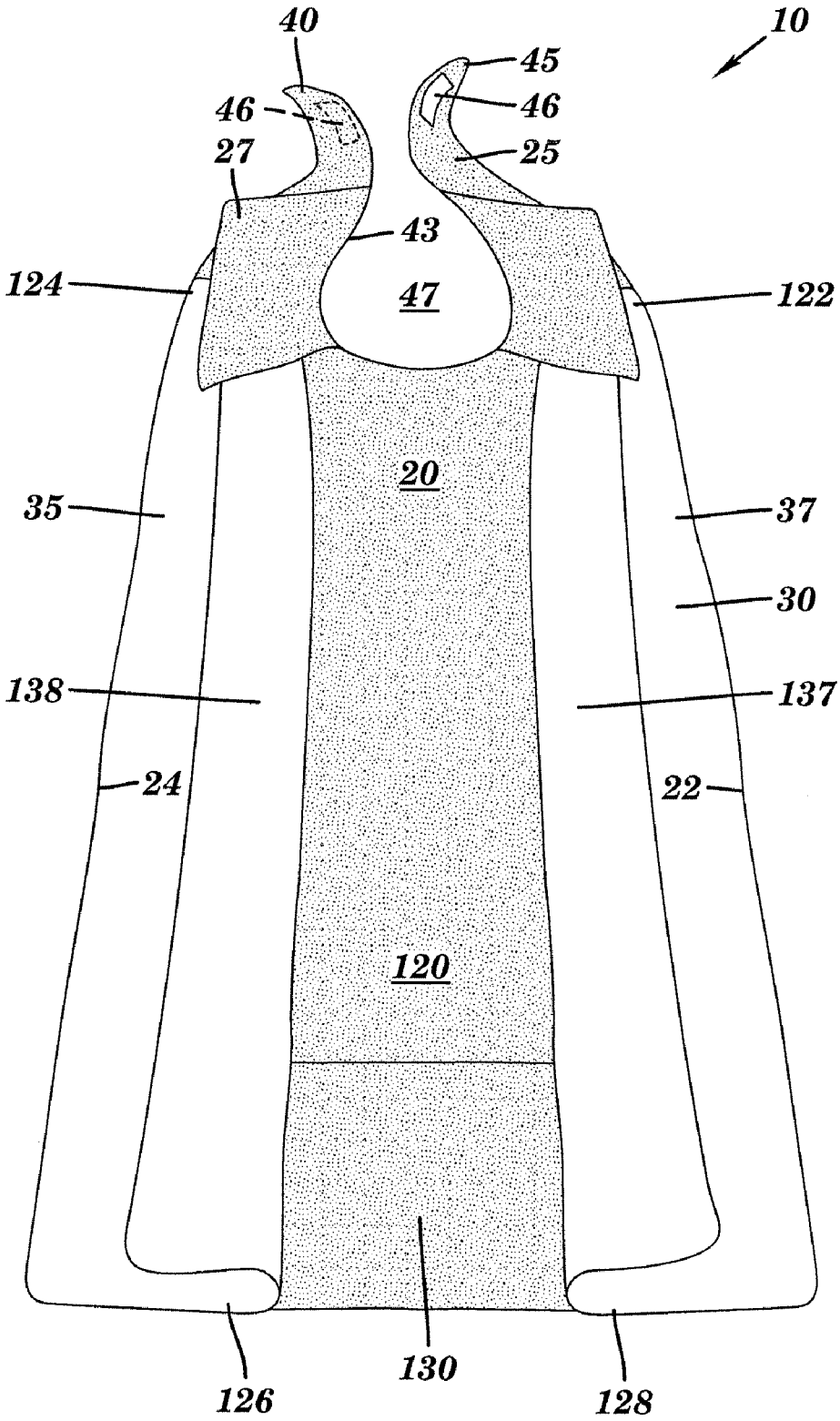
FIG. 1 is a front elevational view of a clothing protector in accordance with the present invention.

In an exemplary embodiment depicted in FIG. 1, a clothing protector system 10 includes a bib portion 20 and a scarf 30. Bib 20 may include a neck-receiving portion 25 having a collar 27 attached thereto. Neck receiving portion 25 may be openable to allow a user to place the neck-receiving portion around his or her neck. For example, a first end 40 may be connected to a second end 45 by a hook and loop type (e.g., VELCRO-type) fastener 46, buttons, or other means of connecting portions of clothing to one another. As depicted in the figures, neck receiving portion 25 may be an arched portion at a top end of bib 20. Further, collar 27 may be attached to an interior radial surface 43 of neck receiving portion 25 defining an opening 47 for receiving the neck of a user.

Figure 3:
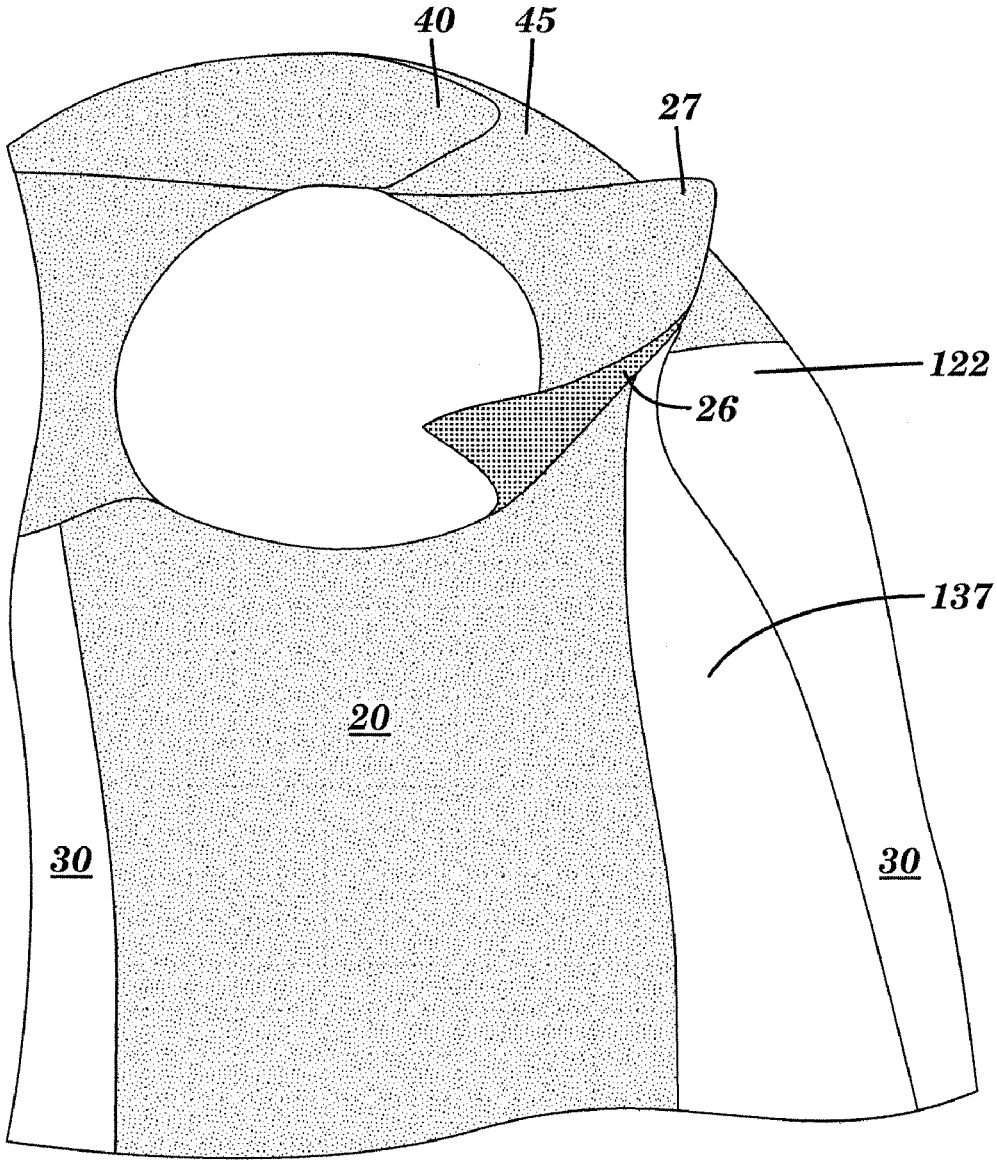
FIG. 3 is an enlarged front elevational view of a portion of the clothing protector of FIG. 1 showing a connection between a collar thereof and a scarf thereof.

Scarf 30 may include a first scarf portion 35 and a second scarf portion 37 which are connected to bib 20 on opposite sides 22 and 24 of bib 20. Scarf portions 35 and 37 may include top ends 122 and 124 which are connected to neck portion 25 and/or collar 27. The connection of top ends 122 and 124 to bib 20 (e.g., at neck portion 25 and/or collar 27) may bias scarf 30 in a direction away from front side 120 of bib 20 and away from a wearer thereof as depicted in FIG. 3. For example, top ends 122 and 124 may be connected to neck receiving portion 25 for a portion of the distance between opposite side 22, 24 to collar 27. Also, a portion of top ends 122 and 124 may be free and the remainder of top ends 122, 124 may be connected to a bottom side 26 of collar 27 as depicted in FIG. 3. The connection of bottom side 26 to one or more of top ends 122, 124 causes such connected portions of the top ends to be elevated relative to the remainder of scarf 30 creating a layered appearance. For example, a first horizontal end 137 of second scarf portion 37 may be folded back on a remainder of second scarf portion 37 to create a layered appearance which covers an interface between a wearer's clothing and clothing protector system 10. More specifically, first horizontal end 137 may hide a point where a wearer's clothing abuts second scarf portion 37. Similarly, a first horizontal end 138 may hide a point where the wearer's clothing abuts first scarf portion 35. Bottom ends 126 and 128 of scarf 20 may be made free (i.e., not connected to bib 20) to perpetuate the illusion of a standard (i.e., not connected) scarf. Bib 20 may also include a crumb catcher pocket 130 on front side 120.

Figure 2:
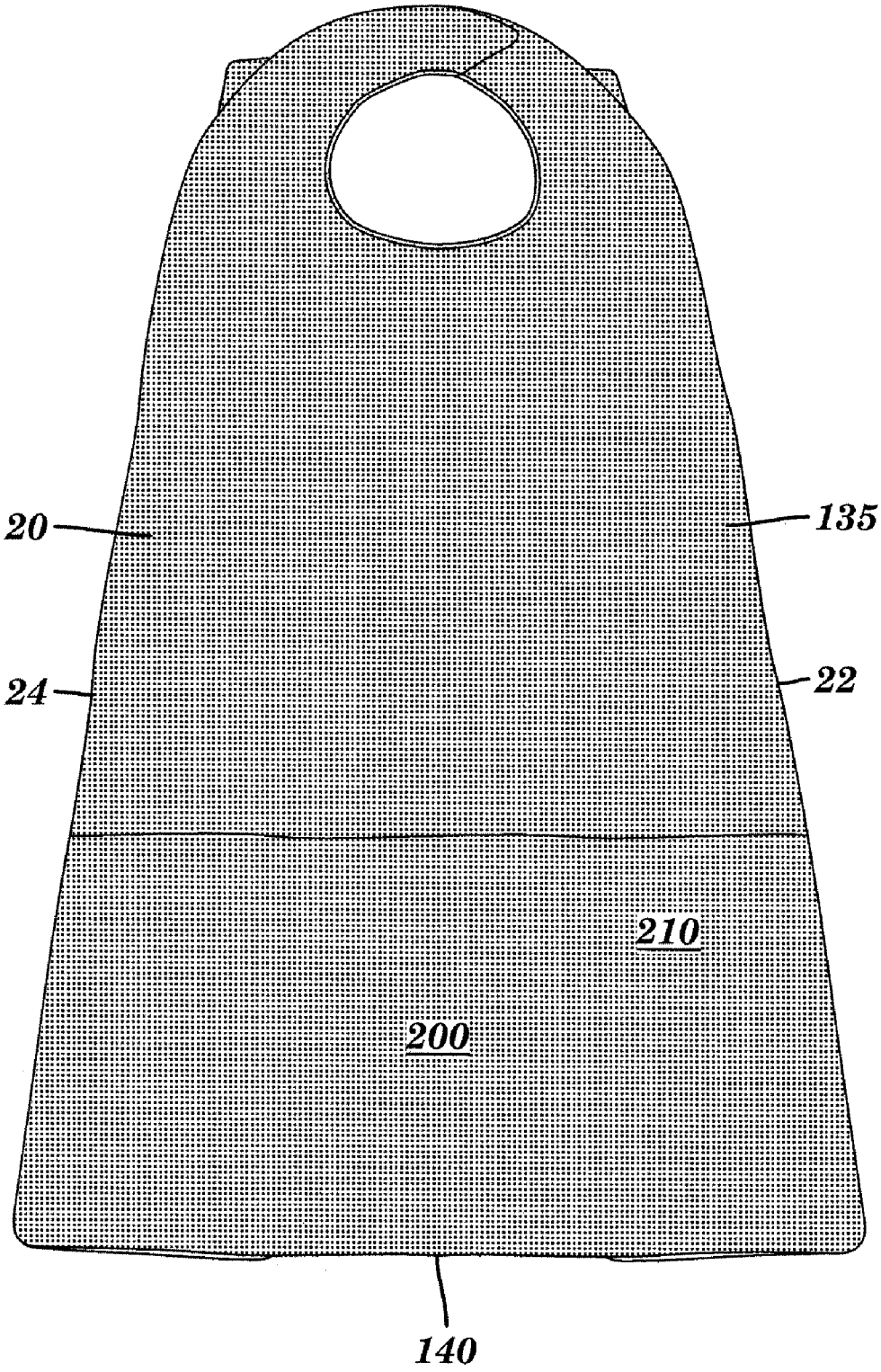
FIG. 2 is a rear elevational view of the clothing protector of FIG. 1.
Figure 4:
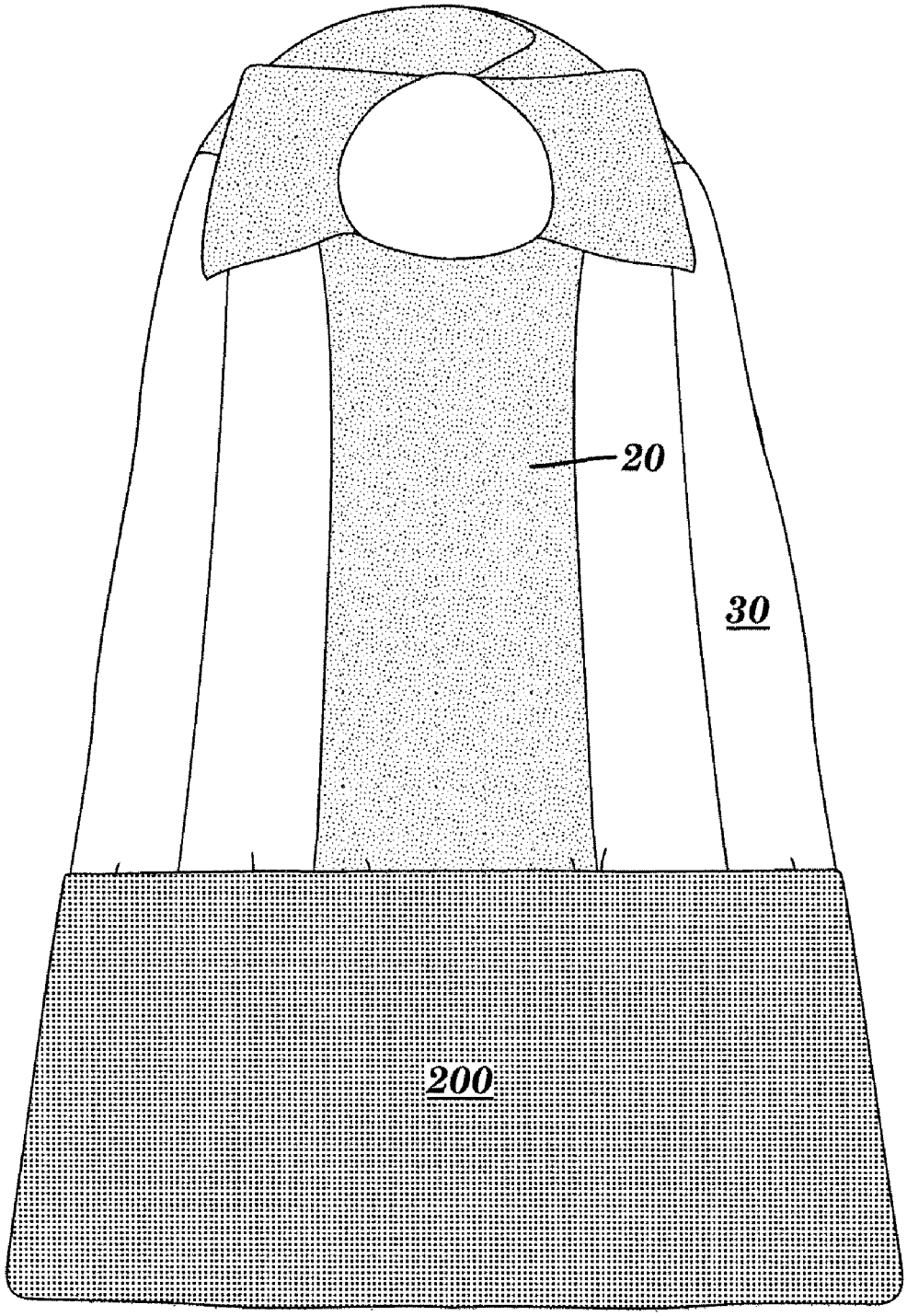
FIG. 4 is a front elevational view of the clothing protector of FIG. 1 showing a receiving pocket thereof, being turned inside-out.
Figure 5:
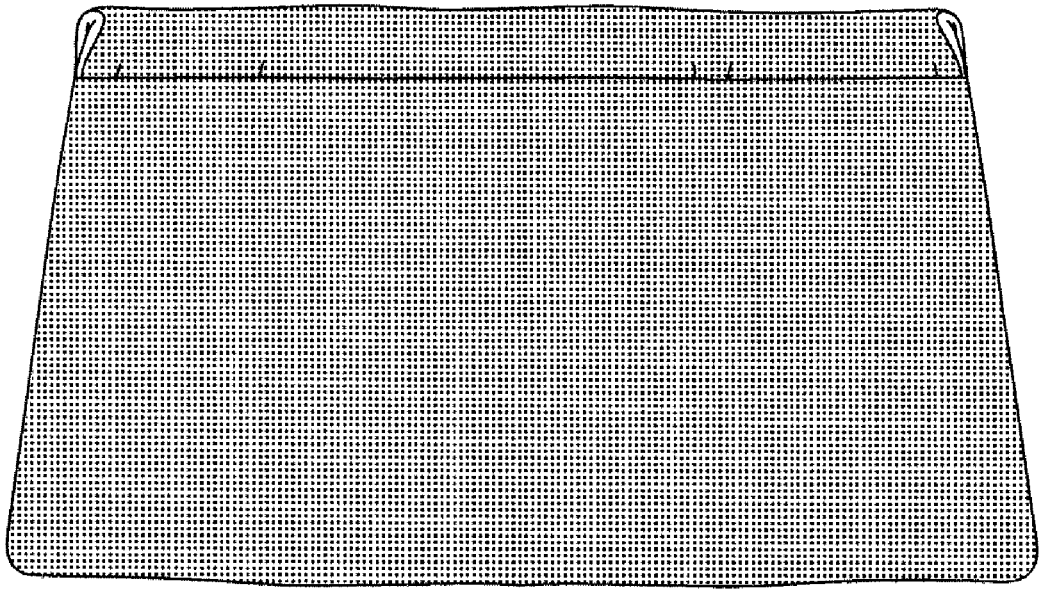
FIG. 5 depicts a front elevational view of the clothing protector of FIG. 1 received in a receiving pocket thereof.

A receiving pocket 200 is attached to a back side 135 of bib 20 as depicted in FIG. 2. Receiving pocket 200 is attached to opposite sides 22 and 24 of bib 20 and a bottom end 140 of bib 20. Receiving pocket 200 may be turned inside out such that an exterior surface 210 of receiving pocket 200 when receiving pocket 200 is located on back side 135 is located in an interior portion (not shown) which may entirely receive bib 20 and scarf 30 therein, as depicted in FIG. 5. For example, receiving pocket 200 may remain on back side 135 with exterior surface 210 located on an exterior back side of bib 20 while system 10 is in use. After such use, pocket 200 may be turned inside-out and the remainder of bib 20 and scarf 30 may be rolled or folded such that they are received in receiving pocket 200. FIG. 4 depicts a first step in the storage of bib 20 within pocket 200 wherein pocket 200 is turned inside-out such that exterior surface 210 is located on a same face as scarf 30 and bib 20. Subsequent to the depiction in FIG. 4, the remainder of clothing protector system 10 may be rolled or folded such that as it is received within pocket 200. Such storage may facilitate the transport of system 10 more easily and may prevent contact of any soiled portions of bib 20 or scarf 30 with the user after bib 20 and scarf 30 are received in pocket 200.

As illustrated in FIG. 2, pocket 200 has a width substantially equivalent to a width of bib 20. Also, crumb pocket 130 located on the front side 120 of bib 20 is utilized to catch crumbs, food, or other debris which may fall on bib 20. When bib 20 and scarf 30 are rolled, folded or otherwise manipulated to allow them to be received in pocket 200, such crumbs, food, or other debris may remain in crumb pocket 130 to facilitate their later disposal.

It will be understood by one skilled in the art that a receiving pocket (e.g., receiving pocket 200) may be configured (e.g., shaped and dimensioned) to receive a remainder of a bib (e.g., bib 20) and/or a scarf (e.g., scarf 30) when turned inside-out, and may be hidden from view (i.e., on a back side there of) while such a bib is in normal use (i.e., during a meal, cooking or other time when there is a danger of food soiling an article of clothing which one seeks to protect).

Also, it will be understood by one skilled in the art that a clothing protector system, such as clothing protector system 10, may be formed of any material (e.g., polyester, nylon) normally used to form a bib and/or clothing protector and which may inhibit staining or other soiling thereof due to typical use.

Also, although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

The invention claimed is:

1. A clothing protector system comprising:

a bib for protecting an article of clothing of a user, the bib having a front side configured to face outwardly from a user, a back side configured to contact the user, and opposite longitudinal sides;

a scarf attached to said opposite longitudinal sides of said bib, said scarf comprising two portions opposite one another across said bib, a first side of each of said scarf portions connected to one of said opposite longitudinal sides of said bib and a second side of each of said scarf portions projecting away from said bib and configured to hide an interface between said bib and the article of clothing when said bib is placed on the article of clothing; and a receiving pocket attached to said bib and configured to receive said bib and said scarf therein, said receiving pocket being connected to said back side of said bib opposite said front side.

2. The system of claim 1 wherein said receiving pocket is configured to be turned inside-out to allow said bib and said scarf to be received entirely therein.

3. The system of claim 2 wherein said receiving pocket comprises an exterior surface and an interior surface when located on said back side of said bib, said exterior surface being located in an interior portion of said receiving pocket when said receiving pocket is turned inside-out to receive said bib and said scarf.

4. The system of claim 1 wherein said receiving pocket is attached to said opposite longitudinal sides such that said receiving pocket is located on said back side.

5. The system of claim 1 wherein bib comprises a bottom end opposite a neck-receiving portion, said receiving pocket being attached to said bottom end.

6. The system of claim 1 wherein said receiving pocket has a width substantially the same as a width of said bib.

7. The system of claim 1 wherein said bib comprises a neck receiving portion and said receiving pocket has a height of about one third of said bib excluding said neck receiving portion of said bib.

8. The system of claim 1 wherein said bib comprises a crumb pocket on said front side.

9. The system of claim 1 wherein said bib and said scarf are entirely received in said receiving pocket.

10. The system of claim 1 wherein said bib comprises a neck-receiving portion and top ends of said scarf portions are attached to said bib between said opposite sides of said bib and said neck-receiving portion.

11. The system of claim 1 wherein each of said scarf portions comprises opposite scarf longitudinal sides attached to said bib, said opposite scarf longitudinal sides comprising said first side and wherein a portion of said each of said scarf portions between said scarf longitudinal sides comprising said second side.

12. A method for use in protecting clothing comprising;

attaching a scarf to a bib for protecting an article of clothing of a user such that opposite scarf portions of the scarf are located opposite one another across the bib, a first side of each of the scarf portions connected to one of the opposite longitudinal sides of the bib and a second side of each of the scarf portions projecting away from the bib and configured to hide an interface between the bib and the article of clothing when the bib is placed on the article of clothing; and attaching a receiving pocket to the bib, the pocket configured to receive the bib and the scarf therein.

13. The method of claim 12 wherein the attaching the receiving pocket to the bib comprises attaching the receiving pocket to a back side of the bib configured to contact the clothing to be protected such that the receiving pocket is hidden from a viewer of the front side during use of the bib.

14. The method of claim 12 wherein the attaching the receiving pocket to the bib comprises attaching the receiving pocket to a back side of the bib such that the receiving pocket is attached to the opposite longitudinal sides on the back side.

15. The method of claim 12 wherein the attaching the receiving pocket to the bib comprises attaching the receiving pocket to a back side of the bib such that the receiving pocket is attached to a bottom end of the bib opposite a neck-receiving portion of the bib.

16. The method of claim 12 wherein the receiving pocket has a width substantially the same as a width of the bib.

17. The method of claim 12 wherein the receiving pocket has a height of about a third of the bib excluding a neck-receiving portion of the bib.

18. The method of claim 12 wherein the attaching the scarf to the bib further comprises attaching the scarf to the bib such that the scarf projects outwardly away from the user.

19. The method of claim 12 wherein the attaching the scarf to the bib further comprises attaching the scarf to the bib such that top ends of the scarf portions are attached to the bib between the opposite sides of the bib and a neck-receiving portion of the bib.

20. The method of claim 12 wherein the attaching the scarf to the bib further comprises attaching the scarf to the bib such that top ends of the scarf portions are attached to a front side of the bib and to a collar of the bib.

21. The method of claim 12 further comprising receiving the bib and the scarf entirely within the receiving pocket.

22. The method of claim 12 further comprising turning the receiving pocket inside-out such that an exterior surface of the pocket when the pocket is located on a back side of the bib is located on an interior of the pocket when the pocket is located on a front side of the bib.

23. The method of claim 12 further comprising arranging the scarf on the article of clothing to hide an interface between the bib and the article of clothing.

* * * * *